United States Patent [19]

Riecker

[11] 4,094,420

[45] June 13, 1978

[54] CHARGING OF AN OVEN CHAMBER OF A BATTERY OF COKE OVENS

[75] Inventor: Johann G. Riecker, Breitscheid, Germany

[73] Assignee: Hartung, Kuhn & Co., Dusseldorf, Germany

[21] Appl. No.: 694,522

[22] Filed: Jun. 10, 1976

Related U.S. Application Data

[62] Division of Ser. No. 563,115, March 28, 1975, abandoned.

[30] Foreign Application Priority Data

Apr. 3, 1974 Germany ..... 2416151

[51] Int. Cl.[2] ..... C10B 31/02

[52] U.S. Cl. ..... 214/35 R; 214/18 PH

[58] Field of Search ..... 222/413; 202/262, 263; 198/548, 558, 616; 214/35 R, 17 C, 18 PH

[56] References Cited

U.S. PATENT DOCUMENTS

| | | | |
|---|---|---|---|
| 383,556 | 5/1888 | Brainard | 196/676 X |
| 1,668,968 | 5/1928 | Lambot | 214/35 R X |
| 3,305,138 | 2/1967 | Plumb | 214/17 C X |
| 3,628,676 | 12/1971 | Tucker | 214/35 R |
| 3,719,307 | 3/1973 | Larson | 222/413 X |
| 3,777,909 | 12/1973 | Rheinfrank | 214/17 C |
| 3,791,320 | 2/1974 | Gidick | 214/18 PH X |

FOREIGN PATENT DOCUMENTS

| | | | |
|---|---|---|---|
| 321,855 | 10/1934 | Italy | 214/35 R |

*Primary Examiner*—Albert J. Makay
*Attorney, Agent, or Firm*—Michael J. Striker

[57] ABSTRACT

A method and an apparatus are disclosed for charging an oven chamber of a battery of coke ovens through charging holes in the oven roof in which the step of charging the coal into the coke oven chamber is effected intermittently.

5 Claims, 8 Drawing Figures

CHARGING OF AN OVEN CHAMBER OF A BATTERY OF COKE OVENS

This is a division, of application Ser. No. 563,115, filed Mar. 28, 1975, now abandoned.

BACKGROUND OF THE INVENTION

This invention relates to a method of and an apparatus for charging the oven chambers of a battery of coke ovens with coal through charging holes in the oven roof.

When a coke oven is charged with coal, charging gases are generally evacuated through at least one collecting pipe which is arranged on at least one longitudinal side of the battery of coke ovens and which communicates with the oven chambers. This known method complies satisfactorily with clean-air requirements, but it is essential to maintain the suction pressure prevailing in the oven throughout the entire charging process by special measures. In one known charging method, so-called programme charging, the suction pressure prevailing inside the oven chambers is maintained by emptying only one feed hopper of a larry car travelling along the battery of coke ovens at a time, for which purpose only one charging hole at a time is exposed. This results in extremely long charging times which are unacceptable in modern high-speed coke oven plant. Other known larry cars are fitted with elaborate, quick-closing devices whose function is to carry over excess charging gases into adjacent semi-ready ovens. Devices of this kind are particularly necessary for charging ovens with only one gas collector pipe, or main. In this case, suction through the collecting pipe or main, is not intense enough to suck the charging gases through the dense "curtains" of inflowing coal which are inevitably formed in conventional charging processes.

All conventional charging processes without any external evacuation system on the larry car itself require large quantities of steam, which are injected into the take-off mains of the particular oven to be charged, for building up a sufficiently powerful internal suction in order to overcome the curtains of coal formed by the streams of coal flowing through the charging openings. It is especially in modern high-capacity ovens that one gas collector main is not sufficient for building up an adequate reduced pressure. In many cases, this makes it necessary to provide two collector mains with correspondingly increased costs.

In cases where preheated coal is introduced into the coke oven chambers, the problems described above are made more acute by the considerably greater accumulation of charging gases, because it is not possible with known systems to introduce the coal into the oven chambers in the absence of air on account of process difficulties.

An object of the present invention is to provide a method by which coke ovens can be charged with coal whilst, at the same time, charging gases are safely removed under suction through a collecting main.

SUMMARY OF THE INVENTION

According to one aspect of the invention there is provided in a method of charging an oven chamber of a battery of coke ovens with coal through charging holes in the oven roof, the step of charging the coal into the coke oven chamber intermittently.

As a result of the interruption of the streams of coal being charged into the coke oven chamber, the collecting pipe is in permanent communication with the entire internal volume of the oven chamber, normally through a take-off main, so that the charging gases can be completely evacuated.

According to another aspect of the invention there is provided in association with a battery of coke ovens having, on at least one longitudinal side thereof, a collector main for untreated gases communicating with the coke oven chambers, and having on the roof thereof a larry car which is provided with a number of coal feed hoppers corresponding in number to the number of charging openings for each oven chamber, apparatus comprising means for charging the coal into a coke oven chamber intermittently.

The time intervals during which the inputs of coal are interrupted can be increased as the filling level of an oven chamber increases. This measure takes into account the fact that the quantity of charging gases formed increases with the amount of coal introduced into the oven chamber, whereas the empty space available inside the oven chamber for evacuating the charging gases into the collector main becomes increasingly smaller.

In another embodiment of the invention, all the inputs of coal may be successively interrupted. This is best done by interrupting the inputs of coal at successive time intervals, beginning with the stream of coal furthest away from the collector main. In this way, the gaps formed by the interruption in the individual inputs of coal form as it were a flow channel which rises towards the oven roof on the side of the collector main. This measure is particularly appropriate in cases where a relatively large number of charging holes is provided for each oven chamber and where the battery of coke ovens comprises a collector main on only one longitudinal side.

The method according to the invention may be carried out inter alia by an arrangement comprising a battery of coke ovens which comprises, on at least one longitudinal side, a collector main for the untreated gases designed to communicate with the oven chambers and along whose roof travels a larry car which is provided with a number of coal feed hoppers corresponding to the number of charging opening for each oven chamber, a mechanical conveyor for the coal being installed in a connecting line between each coal feed hopper and the associated charging hole. According to the invention a known arrangement of this kind is distinguished by the fact that the mechanical conveyor is designed to be driven intermittently and/or is provided with an interrupted conveying surface.

More particularly, the mechanical conveyor may consist of a substantially horizontal screw which is rotatable about its longitudinal axis and which connects the outlet of the coal hopper to the telescopic charging pipe. The conveyor screw is best freely mounted in a conveyor pipe. The screw may be driven by a motor whose rotational speed is periodically adjustable. In addition, the screw may also be driven by means of a motor through a gear system whose transmission is periodically adjustable.

In another possible embodiment, the conveyor screw is provided at its front end, looking in the conveying direction, with a circular disc segment whose surface is directed substantially perpendicularly of the longitudinal axis of the conveyor screw. In this connection, it is advisable for the circular disc segment at the front end of the conveyor screw to extend over an angle of from 30° to 180°.

In another possible embodiment, the screw surface of the conveyor screw is interrupted over a part of its length substantially corresponding to a lead angle of from 30° to 180°.

In another embodiment, the screw surface of the conveyor screw is interrupted over a lead angle of from 30° to 180°.

In addition, the conveyor screw may comprise at its front end, looking in the conveying direction, an extension in the form of a hollow cylindrical segment which closes the upper opening of a telescopic charging pipe during part of each revolution of the conveyor screw.

Finally, a periodically actuated flat slide valve or rotary slide valve may be provided in each charging telescope.

For a better understanding of the invention, and to show how the same may be carried into effect, reference will now be made, by way of example, to the accompanying drawings in which.

Figure 1:
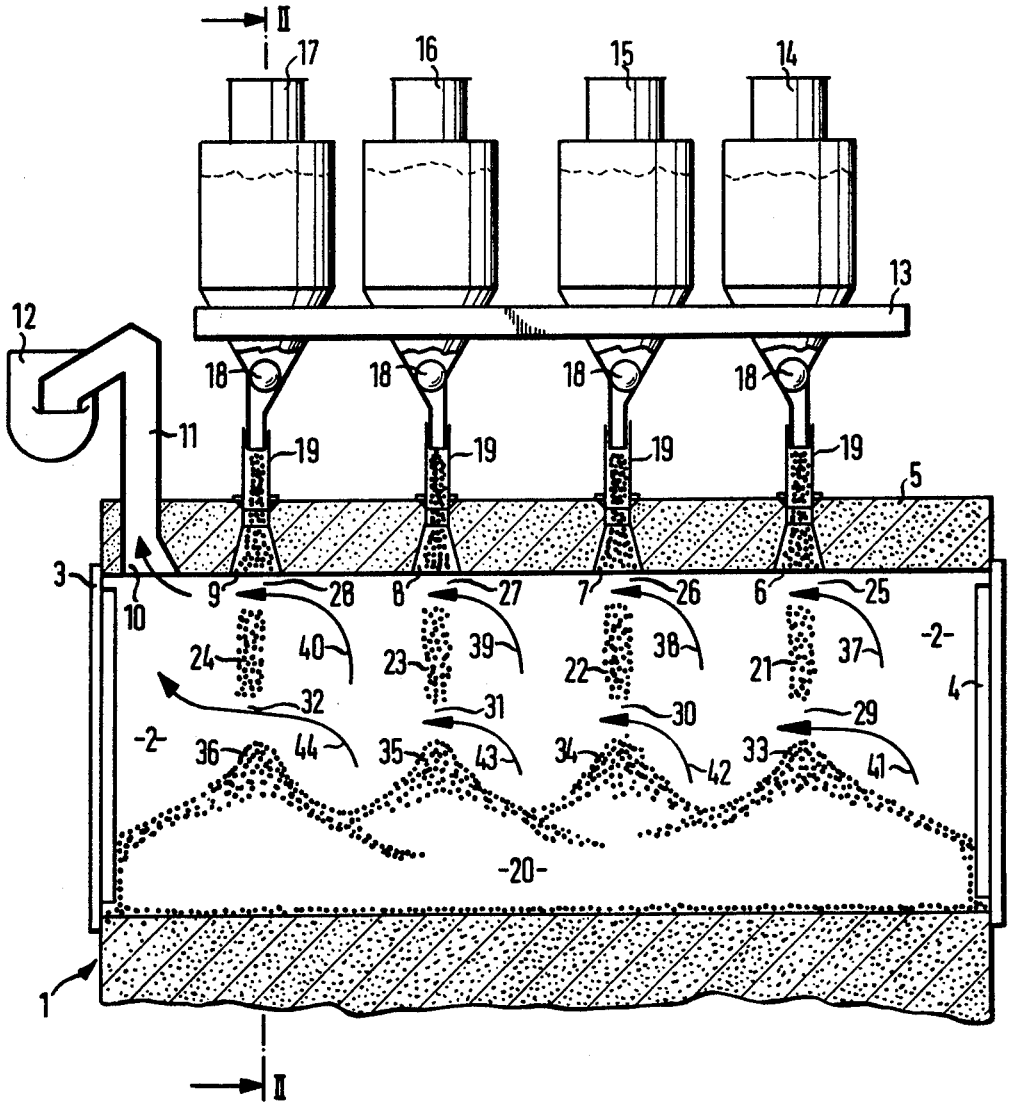
FIG. 1 is a diagrammatic vertical longitudinal section through the oven chambers of a battery of coke ovens with a larry car in the charging position.

In FIG. 1, the reference 1 denotes a battery of coke ovens whose oven chamber 2 is closed on both sides by oven doors 3 and 4. In the roof 5 of the battery of coke ovens, charging holes 6, 7, 8 and 9 are associated with each oven chamber, being distributed at intervals over the length of the oven chamber. Another opening 10 in the oven roof 5 opens into a take-off main, or acsension pipe, 11 which is connected to a collecting pipe, or main 12 which extends along one longitudinal side of the battery of coke ovens and which is used for removing the untreated gases from the oven chambers.

Figure 2:
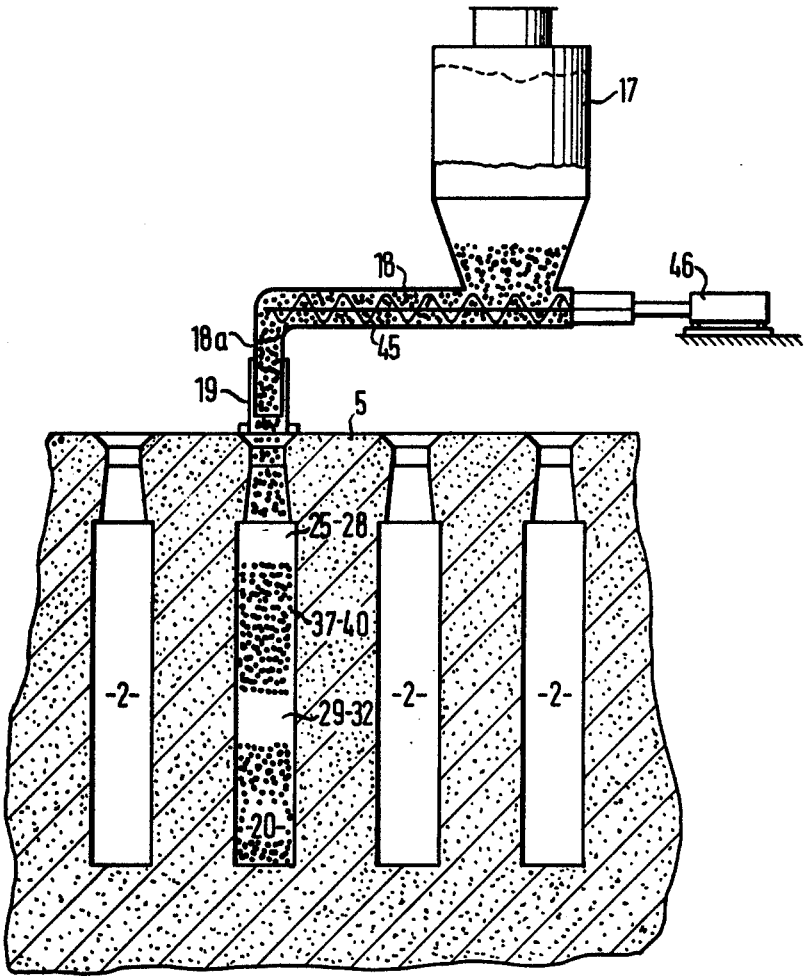
FIG. 2 is a cross-section along the line II — II of FIG. 1.

A larry car provided with four feed hoppers 14, 15, 16 and 17 is arranged to travel along the oven roof. As shown in FIG. 2, the feed hoppers are connected through a delivery pipe 18 to a vertical telescopic pipe 19 which is designed to move up and down in gastight manner relative to the vertical section 18*a* of the delivery pipe and to be fitted onto the lip of the charging hole in substantially gastight manner.

FIGS. 1 and 2 show the larry car and the oven chamber 2 during introduction of the coal into the oven chamber, the coal which already lies on the bottom of the oven chamber being denoted by the reference 20.

According to FIG. 1, the streams of coal 21, 22, 23, 24 issuing from the feed hoppers 14, 15, 16, 17 are intermittently discharged so that gaps 25, 26, 27, 28 and 29, 30, 31, 32 are left between the streams of coal 21, 22, 23, 24 and, on the one hand, the following stream of coal issuing from the corresponding streams of coal 33, 34, 35, 36 previously discharged into the oven chamber, denoted by the arrows 37, 38, 39, 40 and 41, 42, 43, 44, respectively. It can be seen that the gaps 25, 26, 27, 28 and 29, for example, are at substantially the same level, resulting in the formation of flow channels, indicated by the arrows, which also keeps that part of the oven chamber remote from the take-off main opening 10 in permanent communication with the take-off main. Accordingly, the charging gases ascending from the coal 20 as it becomes heated in the oven chamber can be drawn off into the collector main through these gaps between the individual streams or curtains of the coal without any interference under the effect of a reduced pressure generated in the take-off main by injecting stream in known manner.

Whereas, in the embodiment illustrated in FIG. 1, the streams of coal issuing from the individual feed hoppers, 14, 15, 16, 17 are all interrupted at the same time, it can be of advantage successively to interrupt the streams of coal issuing from the feed hoppers 15, 16, 17 after the interruption in the stream of coal issuing from the coal feed hopper 14, so that in this case the flow channel indicated by the arrows 41, 42, 43 and 44, instead of being substantially horizontal as in FIG. 1, climbs in stages towards the take-off main opening 10, beginning with the gap 29 indicated by the arrow 41. The natural ascent of the charging gases encounters this upwardly staggered arrangement (i.e. towards the take-off main opening) of the gaps between the individual streams of coal in the order of the feed hoppers 14, 15, 16, 17, thereby improving the evacuation of the charging gases.

In addition, it can be of advantage to lengthen the periods during which the streams of coal are interrupted with increasing level of the coal filling 20 in the oven chamber, because the empty space available in the oven chamber for receiving the increasingly larger quantities of charging gases becomes smaller, so that it is advisable to give the charging gases more time in which to ascend freely towards the opening 10 of the take-off main.

If a collector main 12 with a corresponding take-off main opening in the roof of the coke oven battery were also provided on the other longitudinal side of the oven bank, the stream of coal issuing from the two feed hoppers 15 and 16 would be the first to be interrupted in the staggered interruption of the individual streams of coal, followed by the stream of coal issuing from the feed hoppers 14 and 17 situated nearer the two take-off mains, in order to facilitate evacuation of the charging gases through the take-off main openings at the two opposite ends of the oven chamber.

It is advisable to provide for active conveying of the coal because it is possible in this way to ensure exact control of the amount of coal introduced per unit of time. According to FIG. 2, a conveyor screw 45 represents structural means for conveying the coal, being freely mounted in the delivery pipe 18 and driven intermittently by a drive motor 46. The drive motor may be linked to a control programme by which the motor and hence the conveyor screw are interrupted for the same period at the same intervals. However, the drive motor may also be controlled by extending the periods for which the drive is interrupted towards the end of charging of an oven chamber. In addition, the intervals during which the drive is interrupted may also be varied. In cases where a variable gear system is present, this control may also be carried out simply by controlling the gear system.

Figures 3, 4:
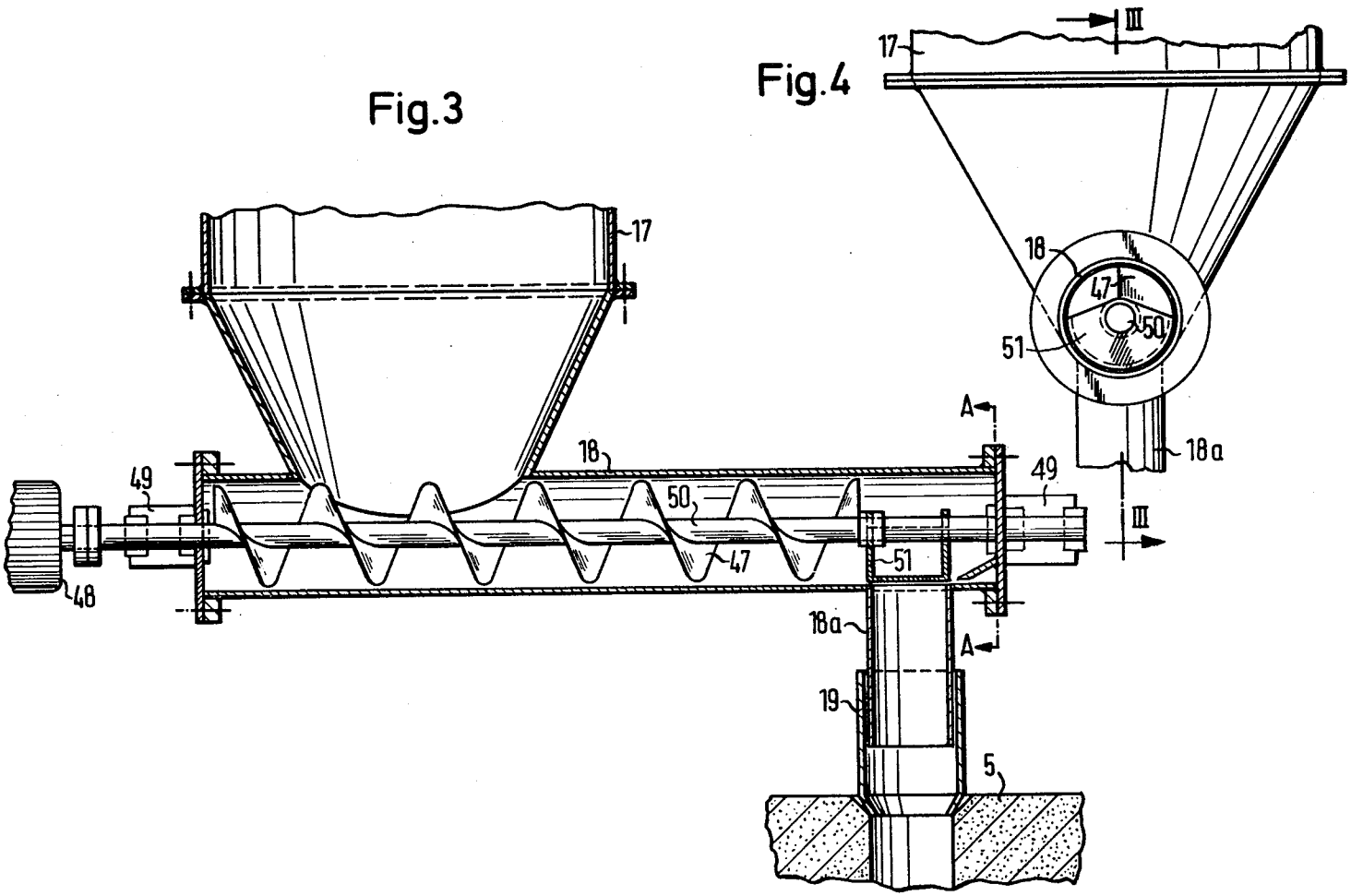
FIG. 3 shows, which in a cross-section on the line III — III of FIG. 4, a feed hopper with a conveyor screw and a telescopic charging pipe in the charging position.
FIG. 4 is a view on the line A—A of FIG. 3.

Another embodiment is shown in FIGS. 3 and 4 where a screw 47 is also designed to be directly driven by a drive motor 48, whilst the shaft is mounted at 49 and, at its front end, the shaft 50 of the screws carries a hollow cylindrical segment 51 whose radius is somewhat smaller than the radius and length of the delivery pipe 18, so that it enables the free cross-section of the vertical section 18*a* of the delivery pipe to be covered and the telescopic charging pipe 19 to be intermittently closed. As a result, the drive motor 48 can generally be driven at the same speed of rotation, although it is also possible to use a variable-speed motor, so that the intervals during which the streams of coal are interrupted and the period for which the stream of coal flows in can be regulated.

As shown in FIG. 4, the hollow cylindrical segment extends over an angle of substantially 180°.

Figure 5:
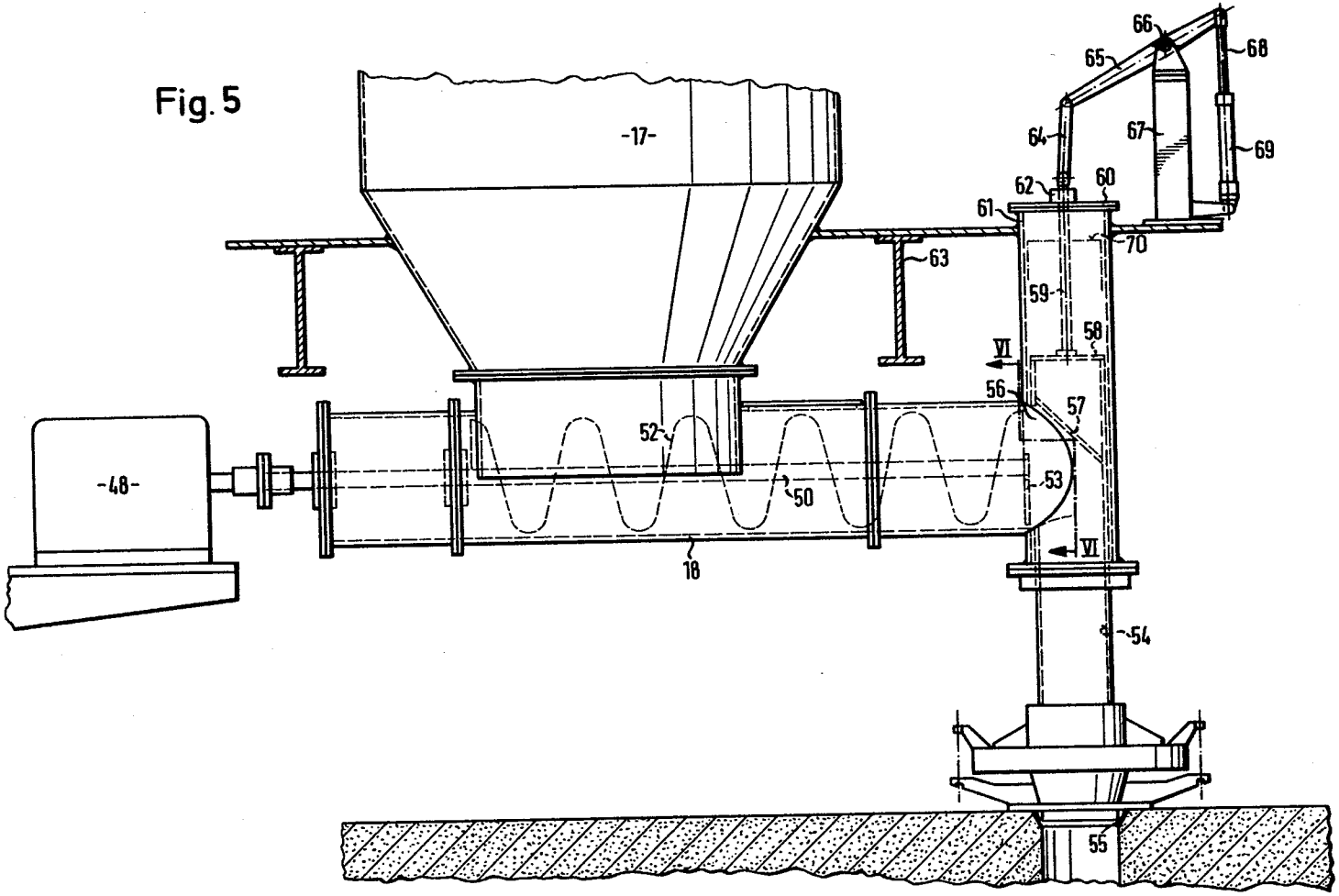
FIG. 5 shows another embodiment of a feed hopper with a conveyor screw having a circular disc segment at one end.
Figure 6:
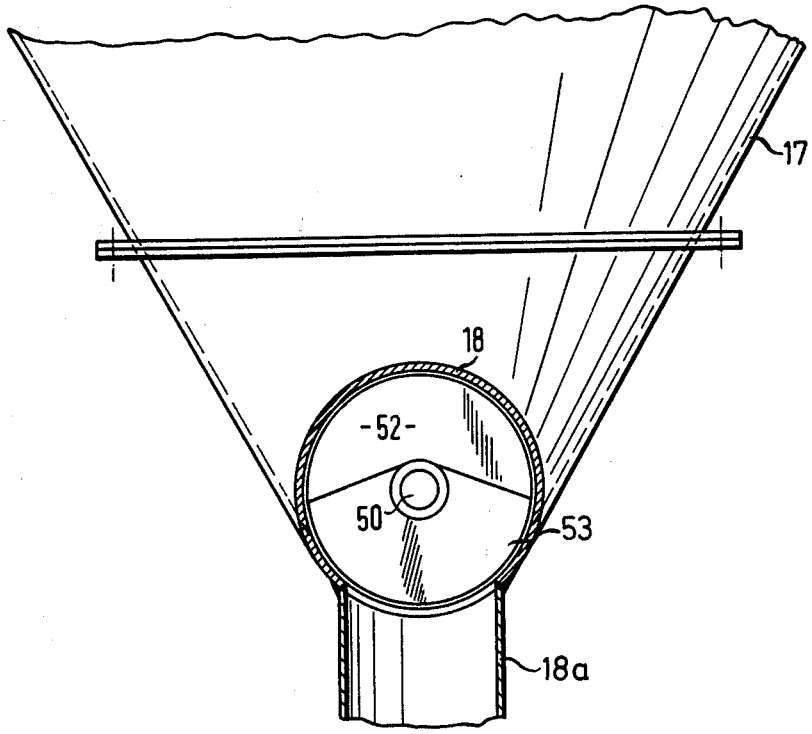
FIG. 6 is a side elevation on the line VI — VI of FIG. 5.

In the embodiment illustrated in FIG. 5, a conveyor screw 52 is shown in chain lines. Once again, the conveyor screw is freely mounted in the delivery pipe 18, but at its front end comprises a circular disc sector 53 whose plane is directed perpendicularly of the shaft 50 of the conveyor screw and, according to FIG. 6, extends over an angle of approximately 180°. Naturally, the sector angle is governed by the rotational speed of the motor and by the interval during which the input of coal is interrupted.

In FIG. 5, the delivery pipe 18 opens into a telescopic pipe 54 in the position in which it has been lowered onto a charging hole 55. In this position, an opening 56 of the telescopic pipe is immediately in front of the opening of the delivery pipe. At its upper end, the telescopic pipe 54 is closed by a downwardly directed baffle 57 in the charging position. An upper end wall 58 of the telescopic pipe is fixedly connected to a rod 59 which is guided for vertical displacement at 62 in the upper end 60 of a guide tube 61. The guide tube 61 is fixedly connected to the chassis 63 of a larry car which also carries the feed hopper 17. A double link rod 64 is connected to that end of the guide rod 59 projecting from the upper end of the guide cylinder 61, its other end being pivotally connected to a double-armed rocker lever 65. Between its two other ends, this rocker lever is mounted to pivot in a vertical plane at 66 on a support 67 fixed to the chassis 63, and, at its other end, is pivotally connected to the piston rod 68 of a hydraulic cylinder 69 whose lower end is in turn pivotally connected to the support 67. This ensures that, when the hydraulic cylinder 69 is actuated, the telescopic pipe 54 is lifted into the chain-dot position denoted by the reference 70, so that the discharge opening of the delivery pipe 18 is closed by the telescopic pipe.

Figure 7:
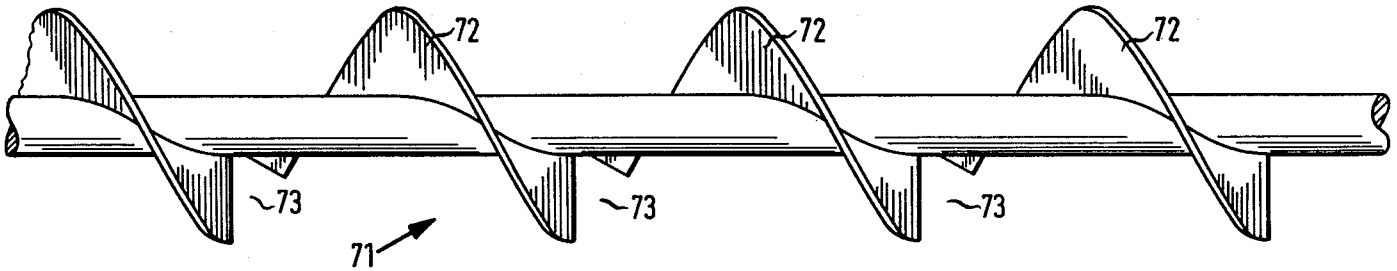
FIG. 7 shows a conveyor screw with an interrupted screw surface.
Figure 8:
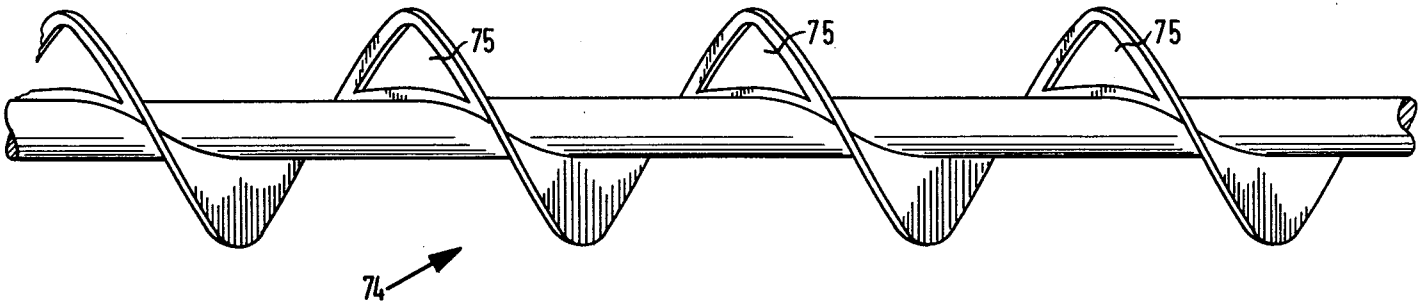
FIG. 8 shows a conveyor screw with a partly interrupted screw surface.

FIG. 7 shows a conveyor screw 71 whose screw surface 72 is interrupted at 73 at equal angular intervals of from 30° to 180°. An interruption in the input of coal may also be obtained in this way and may be varied in dependence upon the rotational speed of the screw. Finally, FIG. 8 shows another embodiment of a screw 74 in which the screw surface is interrupted at 75 at equal intervals.

In contrast to the exemplary embodiments described above, it is of course also possible to install in the telescopic charging pipe periodically operable flat or rotary slide valves by which the streams of coal may be interrupted.

What we claim is:

1. An apparatus for charging an oven chamber of a battery of coke ovens with coal through charging openings in an oven roof, comprising a larry car movable over said oven roof and provided with coal feed hoppers each having an outlet hole, said hoppers corresponding in number of said openings in said oven roof; and conveying means adapted for conveying said coal from each of said hoppers into said oven chamber, said conveying means including a plurality of pipes each operative for connecting one of said outlet holes of said hoppers with one of said charging opening in said oven roof, and a plurality of conveyor screws each located in one of said pipes and rotatable about its own longitudinal axis, each of said conveyor screws having a leading end as considered in the direction of coal conveying and is provided at said leading end with an extension configurated as a hollow cylindrical segment, said cylindrical segment being rigid with and in a fixed position relative to the respective conveyor screw for joint rotation therewith about said axis, said hollow cylindrical segment being adapted to close an associated one of said charging openings in said oven roof during a part of each revolution of the respective conveyor screw, so as to intermittently charge the coal from said outlet hole of said hopper into the corresponding opening of the oven roof.

2. An apparatus for charging an oven chamber of a battery of coke ovens with coal through charging openings in an oven roof, comprising a larry car movable over said oven roof and provided with coal feed hoppers each having an outlet hole, said hoppers corresponding in number of said openings in said oven roof; and conveying means adapted for conveying said coal from each of said hoppers into said oven chamber, said conveying means including a plurality of conduits each operative for connecting one of said outlet holes of said hoppers with one of said charging opening in said oven roof, and a plurality of rotatable screw conveyors each located in one of said conduits and rotatable about its own longitudinal axis, each of said rotatable screw conveyors having means for intermittently charging the coal from said outlet hole of said hopper into the corresponding opening in the oven roof, said intermittently charging means being rigid with and in a fixed position relative to the respective rotatable screw conveyors for joint rotation therewith about said axis; each of said rotatable screw conveyors having a leading end as considered in the direction of coal conveying and said means being formed as an extension provided at said leading end and configurated as a hollow cylindrical segment, said hollow cylindrical segment being adapted to close an associated one of said charging openings in said oven roof during a part of each revolution of said conveyor screw.

3. An apparatus as defined in claim 4, further comprises a plurality of telscopic charging pipes each fitted onto a lip of a respective one of said openings in said oven roof, each of said conveyor pipes connecting said outlet hole of one of said hoppers with a respective one of said telescopic charging pipes.

4. An apparatus for charging an oven chamber of a battery of coke ovens with coal through charging openings in an oven roof, comprising a larry car movable over said oven roof and provided with coal feed hoppers each having an outlet hole, said hoppers corresponding in number of said openings in said oven roof; and conveying means adapted for conveying said coal from each of said hoppers into said oven chamber said conveying means including a plurality of conduits each operative for connecting one of said outlet holes of said hoppers with one of said charging opening in said oven roof, and a plurality of rotatable screw conveyors each located in one of said conduits and rotatable about its own longitudinal axis, each of said rotatable screw conveyors having means for intermittently charging the coal from said outlet hole of said hopper into the corresponding opening in the oven roof, said intermittently charging means being rigid with and in a fixed position relative to the respective rotatable screw conveyors for joint rotation therewith about said axis; each of said rotatable screw conveyors having a leading end as considered in the direction of coal conveying and said means being formed as an extension provided at said leading end said extension being adapted to close an associated one of said charging openings in said oven roof during a part of each revolution of said conveyor screw.

5. An apparatus as defined in claim 4, said extension being formed as a circular disc segment provided at said leading end and having a surface substantially perpendicular to the longitudinal axis of said conveyor screw.

* * * * *